US008777321B2

(12) United States Patent
Masunaga et al.

(10) Patent No.: US 8,777,321 B2
(45) Date of Patent: Jul. 15, 2014

(54) STRETCHING STRUCTURE OF CHAIR UPHOLSTERY MATERIAL

(75) Inventors: Hiroshi Masunaga, Yokohama (JP); Sayaka Morio, Yokohama (JP); Ryou Igarashi, Yokohama (JP)

(73) Assignee: Okamura Corporation (JP)

( * ) Notice: Subject to any disclaimer, the term of this patent is extended or adjusted under 35 U.S.C. 154(b) by 75 days.

(21) Appl. No.: 13/578,066

(22) PCT Filed: Feb. 9, 2011

(86) PCT No.: PCT/JP2011/052756

§ 371 (c)(1),
(2), (4) Date: Aug. 9, 2012

(87) PCT Pub. No.: WO2011/099522

PCT Pub. Date: Aug. 18, 2011

(65) Prior Publication Data

US 2012/0313419 A1 Dec. 13, 2012

(30) Foreign Application Priority Data

Feb. 10, 2010 (JP) ..... 2010-027957
Mar. 18, 2010 (JP) ..... 2010-062027

(51) Int. Cl.
*A47C 31/02* (2006.01)
*A47C 7/02* (2006.01)

(52) U.S. Cl.
USPC ..... 297/452.56; 297/440.15; 297/447.4; 297/448.2; 297/450.1

(58) Field of Classification Search
USPC ..... 297/218.1, 218.2, 218.3, 218.4, 218.5, 297/452.56, 440.15, 447.4, 448.2, 449.1, 297/450.1
See application file for complete search history.

(56) References Cited

U.S. PATENT DOCUMENTS 5,338,091 A * 8/1994 Miller ..... 297/452.56 X
6,152,534 A * 11/2000 Maeda et al. ..... 297/452.56

(Continued)

FOREIGN PATENT DOCUMENTS

JP 56-69063 Y 10/1954
JP 7-37552 Y2 8/1995

(Continued)

OTHER PUBLICATIONS

JP 56-69063—English Abstract, Jun. 8, 1981.

(Continued)

*Primary Examiner* — Rodney B White
(74) *Attorney, Agent, or Firm* — McKee, Voorhees & Sease, P.L.C.

(57) ABSTRACT

A stretching structure in which upholstery material can be installed in a frame body, enough deflection allowance of the upholstery material can be ensured. Upholstery material (14) is installed on the surface of a frame body (13) in a closed-loop shape, and is used as the seat or the backrest of a chair. A cross-sectional shape perpendicular to the longitudinal direction of each of the sections of the frame body (13) is provided with an upholstery material receiving section (21) having an engaging groove (20) which is open to the back surface side, and a U-shape section (23) having a recessed groove (22) which is open to the surface side inward more than the engaging groove (20). The upholstery material (14) is wound from the surface of the frame body (13) to the back surface side along the outer peripheral surface, and the edge section is fitted in the engaging groove (20) and tied up, thereby installing the upholstery material (14) in such a manner as to cover the surface of the U-shape section (23).

6 Claims, 10 Drawing Sheets

(56) References Cited

U.S. PATENT DOCUMENTS

| | | | | |
|---|---|---|---|---|
| 6,231,125 | B1 * | 5/2001 | Maeda et al. | 297/452.56 |
| 6,375,269 | B1 * | 4/2002 | Maeda et al. | 297/452.56 |
| 6,722,741 | B2 * | 4/2004 | Stumpf et al. | 297/452.56 X |
| 6,886,890 | B2 * | 5/2005 | Rowland et al. | 297/452.56 |
| 6,899,398 | B2 * | 5/2005 | Coffield | 297/452.56 |
| 6,942,300 | B2 * | 9/2005 | Numa et al. | 297/452.56 |
| 6,966,606 | B2 * | 11/2005 | Coffield | 297/452.56 |
| 7,008,021 | B2 * | 3/2006 | Schultz et al. | 297/452.56 |
| 7,055,911 | B2 * | 6/2006 | Simpson et al. | 297/452.56 X |
| 7,270,378 | B2 * | 9/2007 | Wilkerson et al. | 297/452.56 |
| 7,416,256 | B2 * | 8/2008 | Fujita et al. | 297/452.56 |
| 7,425,039 | B2 * | 9/2008 | Lin | 297/452.56 |
| 7,434,888 | B2 * | 10/2008 | Lin | 297/452.56 |
| 7,481,493 | B2 * | 1/2009 | Fujita et al. | 297/452.56 X |
| 7,503,627 | B2 * | 3/2009 | Kawasaki | 297/452.56 |
| 7,618,096 | B2 * | 11/2009 | Fujita et al. | 297/452.56 |
| 7,647,714 | B2 * | 1/2010 | Coffield et al. | 297/452.56 X |
| 7,731,295 | B2 * | 6/2010 | Lin | 297/452.56 |
| 7,837,272 | B2 * | 11/2010 | Masunaga et al. | 297/452.56 |
| 7,971,939 | B2 * | 7/2011 | Fujita et al. | 297/452.56 |
| 8,109,576 | B2 * | 2/2012 | Lin | 297/452.56 |
| 8,251,454 | B2 * | 8/2012 | Tsukiji et al. | 297/452.56 X |
| 8,672,404 | B2 * | 3/2014 | Hennig et al. | 297/218.3 |
| 2002/0060493 | A1 * | 5/2002 | Nishino et al. | 297/452.56 |
| 2002/0096932 | A1 * | 7/2002 | Fujita et al. | 297/452.56 |
| 2003/0168901 | A1 * | 9/2003 | Wilkerson et al. | 297/452.56 |
| 2005/0057085 | A1 * | 3/2005 | Wu | 297/452.56 |
| 2006/0125305 | A1 * | 6/2006 | Schultz et al. | 297/452.56 |
| 2006/0279119 | A1 * | 12/2006 | Fujita et al. | 297/284.2 |
| 2007/0102987 | A1 * | 5/2007 | Chen | 297/452.56 |
| 2007/0170756 | A1 * | 7/2007 | Kang | 297/452.56 X |
| 2008/0079307 | A1 * | 4/2008 | Su | 297/452.56 |
| 2008/0106136 | A1 * | 5/2008 | Heidmann et al. | 297/452.56 |
| 2008/0284229 | A1 * | 11/2008 | Masunaga et al. | 297/452.18 |
| 2008/0315661 | A1 * | 12/2008 | Lin | 297/452.56 |
| 2010/0176646 | A1 * | 7/2010 | Rowland et al. | 297/452.56 |

FOREIGN PATENT DOCUMENTS

| | | |
|---|---|---|
| JP | 07-265564 | 10/1995 |
| JP | 10/057188 | 3/1998 |
| JP | 2001-275780 | 10/2001 |
| JP | 2003-166510 | 6/2003 |
| JP | 2004-113503 | 4/2004 |
| JP | 2006-110001 | 4/2006 |
| JP | 2006-271622 | 10/2006 |
| JP | 2007-289705 | 11/2007 |

OTHER PUBLICATIONS

JP 7-37552—English Abstract, Aug. 30, 1995.

* cited by examiner

STRETCHING STRUCTURE OF CHAIR UPHOLSTERY MATERIAL

CROSS-REFERENCE TO RELATED APPLICATIONS

This is a National Phase application claiming priority to PCT/JP2011/052756 filed Feb. 9, 2011 which claims priority under 35 U.S.C. §119 to JP 2010-027957 filed Feb. 10, 2010 and JP 2010-062027 filed Mar. 18, 2010, all of which are herein incorporated by reference in their entireties.

TECHNICAL FIELD

The present invention relates to the stretching structure of upholstery material for a chair in which the upholstery material is stretched over a closed-loop frame, wherein the stretching structure is used as the seat or the backrest of the chair.

BACKGROUND OF THE INVENTION

In a conventional stretching structure for a chair, a groove is formed in the corner of the front side of a vertical frame, and engages with the edge which is mounted to the end of upholstery material wound in at almost 360 degrees around the outer circumferential surface, rear surface and inner circumferential surface. The end of the upholstery material is folded in a U-shape and the edge mounted to the end is engaged in a groove in an outer side surface of the frame as shown in Patent Literature 1.

A groove is formed at the back side of a vertical frame and upholstery material is wound around the front side, outer circumferential surface and part of the rear surface. The edge at the end of the upholstery material is engaged in the groove as shown in Patent Literature 2.

PRIOR ART

Patent Literatures

Patent Literature 1: JP2006-110001A
Patent Literature 2: JP2001-275780A

SUMMARY OF THE INVENTION

Problems to be Solved by the Invention

However, in the structure in which the upholstery material is wound on the frame at 360 degrees in Patent Literature 1, it is complicated to wind the upholstery material and to engage the edge in the groove. In the structure in which the edge mounted to the end of the upholstery material engages in the groove in the outer side surface of the frame, it is necessary to increase the depth of the groove so as to engage the edge in the groove securely. So it is necessary to increase the width of the frame which becomes larger resulting in increase in cost.

To form the groove in the outer side surface of the frame, in addition to frontward and backward two-direction dies, dies which are pulled out outward and sideward have to be used thereby making molding complicated and increasing manufacturing cost.

In the structure in which the groove is formed on the back side of the frame in Patent Literature 2, in order to wind covering material on the outer circumferential surface of the frame smoothly, the outer circumferential surface of the frame is formed with larger curvature to increase a cross sectional area of the frame to make the frame larger which results in increase in cost.

In order to solve the disadvantages in the prior art, it is an object of the invention to provide the stretching structure of upholstery material for a chair in which the upholstery material can be stretched over the frame easily, flexible range for the upholstery material being sufficiently ensured, reducing the material cost and manufacturing cost.

Means for Solving the Problems

According to the present invention, the foregoing problems are solved as below.

1. (1) A stretching structure of upholstery material used for a seat or a backrest of a chair, in which the upholstery material is stretched over a closed-loop frame, the frame, in a cross section perpendicular to a longitudinal direction of the same, comprising, an upholstery-material-holding portion having an engagement groove which is open toward a back side of the frame and, a U-shaped portion having a recess which is open toward a front side of the frame and medial to the engagement groove, wherein the upholstery material is wound from the front side toward the back side of the frame along an outer circumferential surface, and a circumference of the upholstery material is engaged in the engagement groove so that the upholstery material is stretched to cover the U-shaped portion.

By the structure, the engagement groove and the recess are formed in only two directions back and forth. Thus, the frame can be molded by two dies of forward and backward directions thereby simplifying the dies and facilitating molding, so that the cost is reduced.

The recess of the U-shaped portion reduces resin material without decreasing strength, thereby lightening the entire frame and reducing material cost. The recess is open toward the back side of the upholstery material, so that the opening is not exposed to the outside to provide good appearance.

In a conventional structure, in which the recess for engaging the periphery of the upholstery material is formed on the outer side of the frame, the recess affects another recess on the outer side for engaging the upholstery material so as to make it impossible to form the recess. In this invention, there is no such restriction to allow the recess to be formed.

Furthermore, the upholstery material is wound from the front side to the back side around the outer circumference, and the circumference is engaged in the engagement groove, so that the upholstery material can be stretched to the frame easily and securely.

(2) In the item (1), a free end of an inner portion of the U-shaped portion is spaced from a back side of the upholstery material when external force does not act.

Flexible range for the upholstery material can be obtained sufficiently.

(3) In the item (1) or (2), a free end of an outer portion of the U-shaped portion is spaced from an outer circumference of the upholstery-material-holding portion along a direction of separating from the back side of the upholstery material, and a free end of the inner portion of the U-shaped portion is more spaced from the back side of the upholstery material than from the free end of the outer portion of the U-shaped portion along the direction of separating from the back side of the upholstery material.

Larger flexible range for the upholstery material can be obtained than the item (2). The upholstery material can be flexed more elastically on the broader range at the back side of the upholstery material. The upholstery material can be held only by the outer circumference of the upholstery-material-holding portion. The inner parts can be flexed elastically providing comfort in use of the chair.

(4) In any one of the items (1) to (3), a surface formed by connecting the outer circumference of the upholstery-material-holding portion, the free end of the outer portion and the free end of the inner portion is a gently curved or tilted surface concaved from the outer circumference of the upholstery-material-holding portion toward the back side of the upholstery material.

The upholstery material can be flexed more elastically toward the back side of the upholstery material on the broader range thereof and the front side of the frame can be kept in good appearance.

(5) In any one of the items (1) to (4), a cross section perpendicular to a longitudinal direction of the frame is formed like a triangle in which depth becomes larger gradually inward from the outer circumference of the upholstery-material-holding portion.

The chair provides good appearance without decreasing strength.

(6) In any one of the items (1) to (5), in the recess of the U-shaped portion, there is a rib perpendicular to the longitudinal direction of the recess.

The frame is further improved in strength.

Advantages of the Invention

According to the present invention, there is provided the stretching structure of upholstery material for a chair in which the upholstery material can be stretched over the frame easily, flexible range for the upholstery material can be ensured sufficiently without decreasing its strength, and the material cost and manufacturing cost can be reduced.

EMBODIMENTS FOR IMPLEMENTING THE INVENTION

Embodiment 1

Figure 1:
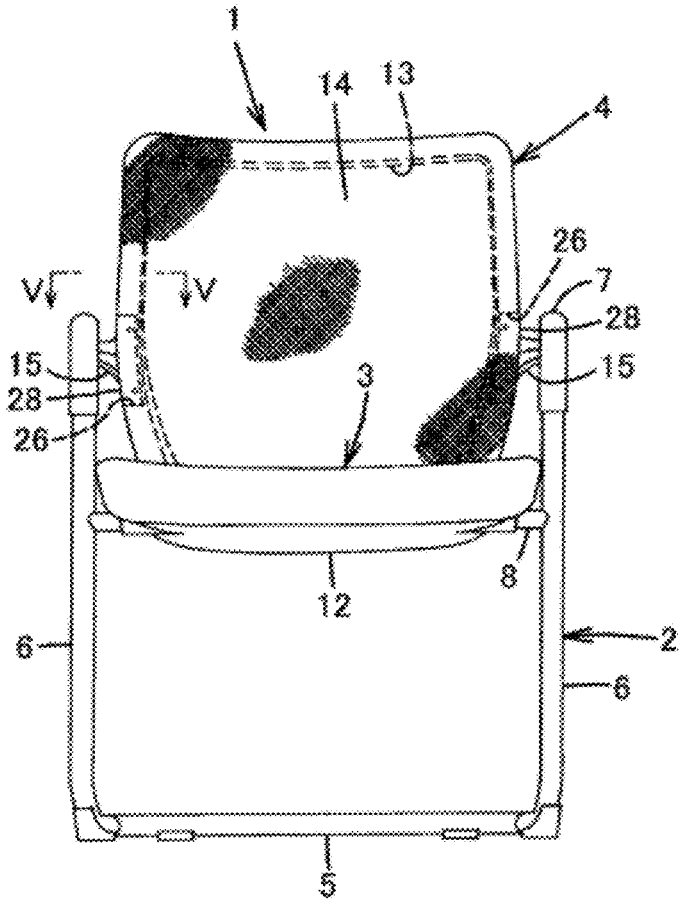
FIG. 1 is a front elevational view of a chair having Embodiment 1 of the present invention.
Figure 2:
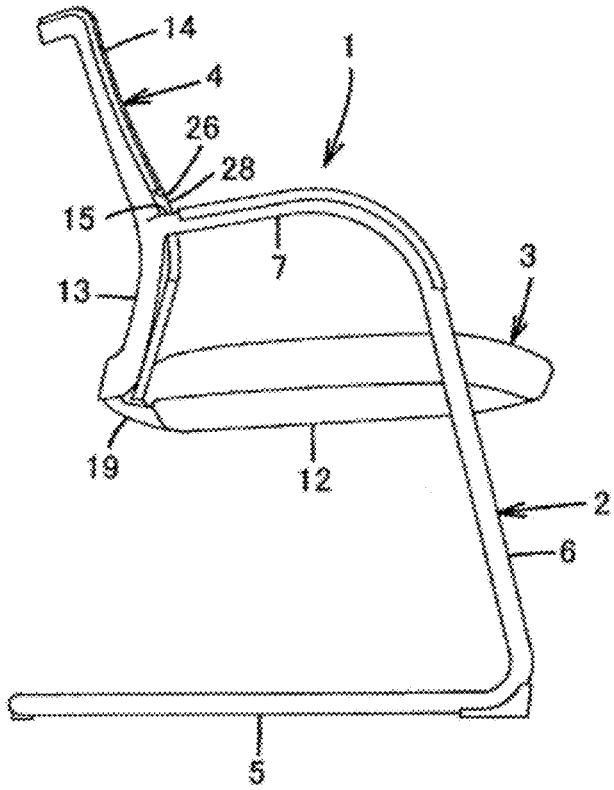
FIG. 2 is a side elevational view of the chair in FIG. 1.
Figure 3:
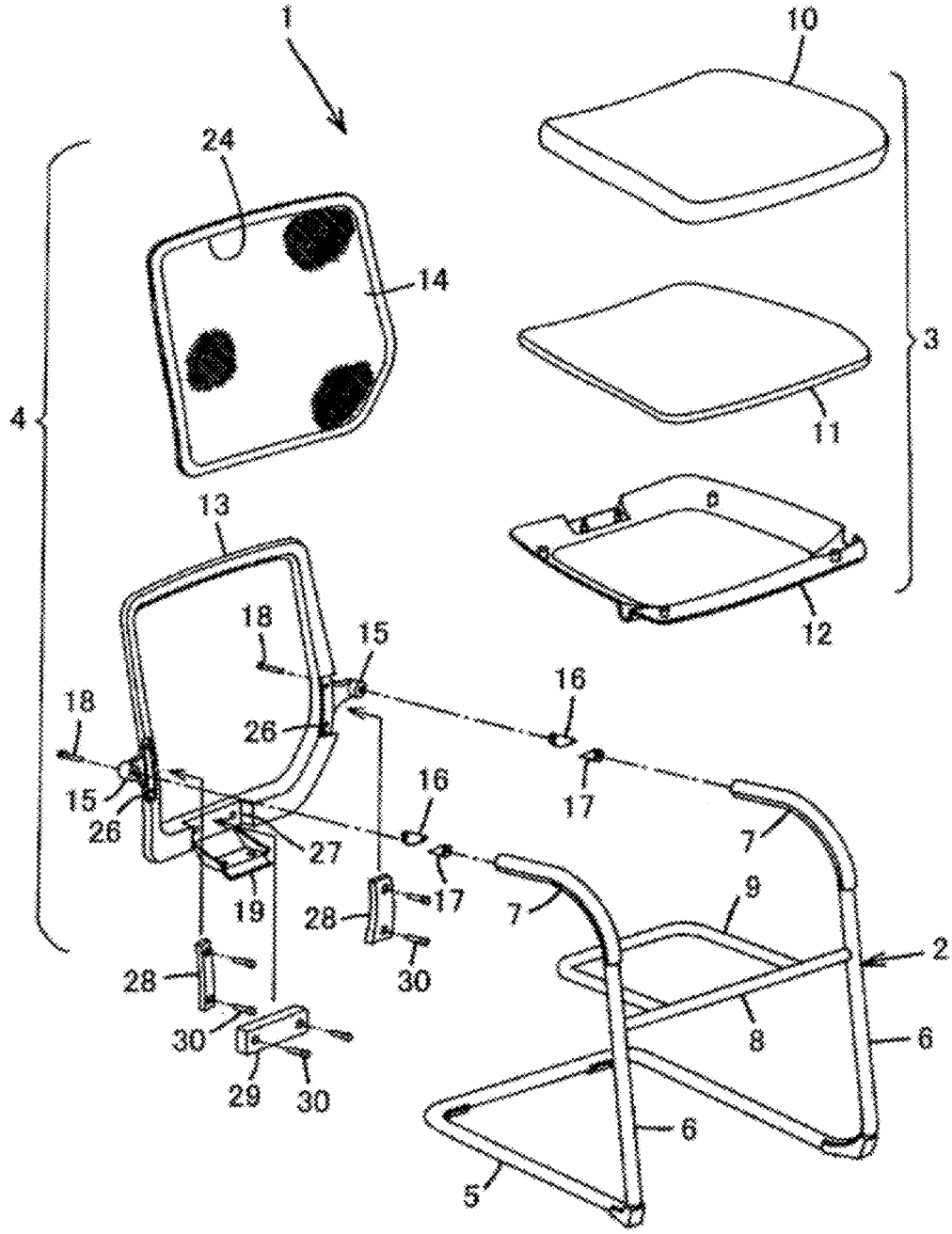
FIG. 3 is an exploded front perspective view in FIG. 1.
Figure 4:
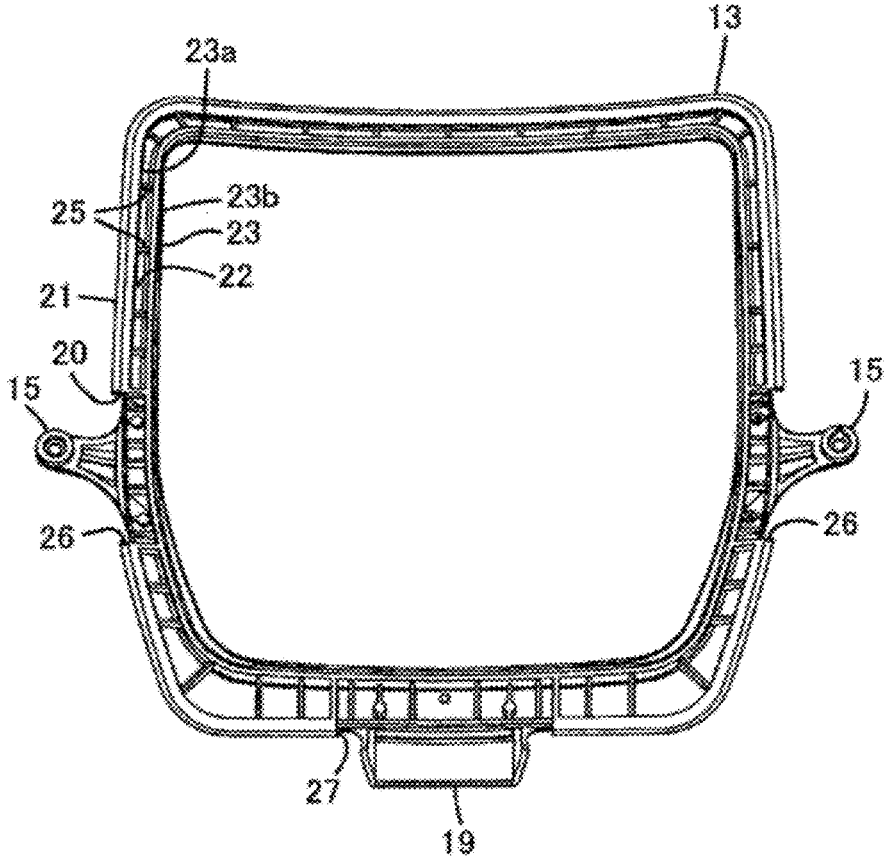
FIG. 4 is a front elevational view of a frame of the backrest in FIG. 1.
Figure 5:
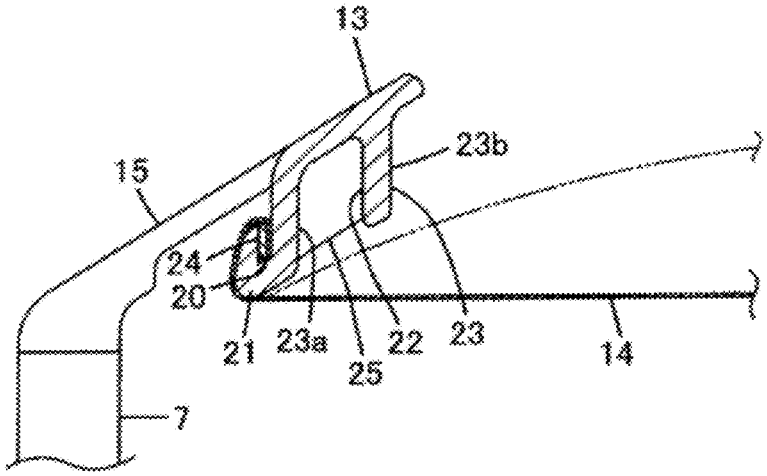
FIG. 5 is an enlarged horizontal sectional plan view taken along the line V-V in FIG. 1.

Embodiment 1 will be described with respect to appended drawings. FIG. 1 is a front elevational view of a chair in which the present invention is applied; FIG. 2 is a side elevational view thereof; FIG. 3 is an exploded front perspective view thereof; FIG. 4 is a front elevational view of a frame of the backrest; and FIG. 5 is a horizontal sectional plan view taken along the line V-V.

The chair 1 comprises a seat 3 and a backrest 4 mounted to a leg frame 2.

The leg frame 2 comprises a U-shaped base 5 which is open at the front end; a pair of front legs 6,6 which stand from the front end of the base 5; a pair of armrests 7,7 which extend horizontally from the upper ends of the front legs 6,6; a lateral rod 8 which connects the front legs 6,6 in the middle; and a U-shaped seat-support rod 9 which is fixed to the lateral rod 8.

In the seat 3, a seat plate 11 on which a cushion material 10 is attached is placed on the lateral rod 8 and the seat-support rod 9 of the leg frame 2. A lower cover 12 is pressed under the seat plate 11. The lower cover 12 is mounted to the seat plate 11 with screws, so that the seat 3 is firmly mounted to the leg frame 2.

In FIG. 4, in the backrest 4*a*, upholstery material 14 is stretched over a rectangular closed-loop frame 13. Ears 15,15 in the middle of the sides of a frame 13 are fixed to the rear ends of the armrests 7,7 with connecting portions 16,17 pressed in the armrests 7, and a bolt 18. A lower connecting part 19 which projects downward from the middle of the lower end of the frame 13 is coupled to the seat plate 11 and lower cover 12 of the seat 3, so that the backrest 4 is firmly mounted to the leg frame 2 and the seat 3.

In FIG. 5, in a cross section perpendicular to a longitudinal direction of the frame 13, there are provided a upholstery-material-holding portion 21 having a longitudinal engagement groove 20 which is open toward a back side of the frame 13; and a U-shaped portion 23 having a recess 22 which is open at a front side. The upholstery material 14 is wound from the front side to the back side of the frame 13 around the outer circumferential surface. An edge 24 on the circumference engages in the groove 20, so that the upholstery material 14 is stretched over the frame 13 to cover the U-shaped portion 23.

When external force does not act to the upholstery material 14, the front end (free end) of an outer portion 23*a* of the U-shaped portion 23 is spaced from the outer periphery of the upholstery-material-holding portion 21 along a direction of separating from the back side of the upholstery material, and the free end of an inner portion 23*b* of the U-shaped portion 23 is more spaced from the back side of the upholstery material 14 than from the free end of the outer portion 23*a* along the direction of separating from the back side of the upholstery material.

The surface formed by connecting the outer end of the upholstery-material-holding portion 21 to the front end of the outer portion 23*a* and the front end of the inner portion 23*b* is a curved surface or tilted surface concaved from the outer end of the upholstery-material-holding portion 21 to the back side of the upholstery material 14.

Furthermore, the cross section perpendicular to the longitudinal direction of the frame 13 is formed like a triangle extending from the outer circumferential end of the upholstery-material-holding portion 21.

The cross section of the frame 13 can ensure sufficient flexible range and increases elastic flexible range at the back side of the upholstery material 14. The upholstery material 14 is received only at the outer end of the upholstery-material-holding portion 21, and the inner parts of the upholstery material can elastically be flexed, thereby improving comfortability in use of the chair and providing good appearance without decreasing its strength.

A plurality of ribs 25 perpendicular to the longitudinal direction of the recess 22 are formed at regular spacings longitudinally in the recess 22 thereby further improving its strength.

In FIGS. 3 and 4, the right and left ears 15,15 and the lower connecting part 19 are formed on the outer circumferential surface of the frame 13 behind the groove 20 of the upholstery-material-holding portion 21. There are formed cut-away portions 26,26,27 in front of mounting parts for the ears 15,15 of the frame 13 on the front side and outer side.

Engagement members 28,29 are engaged in and fixed to the cut-away portions 26,27 with a plurality of screws 30.

Each of the engagement members 28,29 comprises a upholstery-material-holding portion (not shown) and a U-shaped compensating portion (not shown) complementing the upholstery-material-holding portion 21 and the U-shaped portion 23 of the frame 13 formed by the cut-away portions 26,27. The upholstery-material-holding portion of the engagement members 28,29 has an engagement groove (not shown) in line with the engagement groove 20.

In front of the ears 15,15 and the lower connecting part 19, the edge 24 mounted to the circumference of the upholstery material 14 engages in a groove of each of the engagement members 28,29 and is mounted in the groove, so that the upholstery material 14 is mounted to the frame 13 securely without breakage.

According to Embodiment 1, there are only two longitudinal directions of the engagement groove 20 and recess 22 of the frame 13. The frame 13 can be molded with two dies of forward and backward directions thereby facilitating molding, so that its cost is reduced.

The recess 22 of the U-shaped portion 23 reduces the amount of resin without decreasing its strength, thereby lightening the entire frame and reducing its cost. The opening of the groove faces the back side of the upholstery material 14, so that the opening is not exposed to the outside to provide good appearance.

In a conventional frame which has a groove in which the upholstery material engages on the outer side surface, the recess 22 cannot be formed due to the interference between the both grooves. In this invention, it is possible to form the large recess 22 because of the absence of such restriction.

The upholstery material 14 is wound from the front side of the frame 13 to the back side along its outer circumference and mounted to the engagement groove, thereby stretching the upholstery material 14 over the frame readily and securely.

Embodiment 2

In office chairs used in offices and meeting rooms, the back of a sitting person is supported with the backrest where elastic cover or upholstery material is stretched. In the backrest of the chair, the upholstery material covers the front side of the back frame like a closed loop molded from metal such as Al which is molded or synthetic resin. The end of the upholstery material engages with the back side of the back frame or a groove of the side, so that the upholstery material is stretched over the backrest such as in JP4061160B.

Meanwhile, cantilever-type chairs in which the backrest is coupled to a pipe-like leg frame have been strongly demanded. The armrest is provided at a coupled portion of the leg frame to the backrest, for example, in JP7-37552U, JP4198322B and JP2007-289705A.

The back frame is coupled in the middle to the rear ends of the armrest of the U-shaped leg frame. The seat is supported by a seat support provided in the middle of a front leg of the leg frame.

However, in the conventional cantilever-type chairs with the armrest, a projection is provided on the front side of the back frame of the backrest, and is coupled to the leg frame. A hole for the projection is formed in the upholstery material and the circumferential edge of the upholstery material is engaged on the back side of the back frame or groove of the side. But the hole is exposed, so that its appearance becomes poor.

Furthermore, in one of the prior art, a projection is provided outward and sideward, and a groove of the back frame is formed forward of the projection (front surface side). However, a direction for pulling out a die to form the groove crosses a direction for pulling out a die to form the projection. The same die cannot be used. Molding increases by one step and is complicated which increases its cost. Such problem occurs not only in case for coupling the backrest to the back frame but also in case for connecting the backrest to the seat.

In view of the disadvantages in the prior art, it is an object of the invention to provide the stretching structure of upholstery material for a chair in which a frame over which the upholstery material is stretched is connected to another member, wherein a die can be pulled out easily when the frame is molded, the upholstery material is prevented from loosening to provide good appearance and reduce the cost.

According to the present invention, the foregoing problems are solved as below.

(1) In the stretching structure of a stretching member for a chair in which upholstery material is stretched over a closed-loop frame, a protrusion is provided on the outer circumferential surface close to the back side of the frame to connect the frame to another member of the chair, and the stretching structure is used as the seat or the backrest, a cut-away portion is formed in the frame closer to the front side than the protrusion, an engagement member engages in the cut-away portion, and grooves which engage with the end of the upholstery material is formed on the outer circumferential surface of the frame closer to the front side than the protrusion and on the outer circumferential surface of the engagement member.

By the structure, the cut-away portion is formed on the frame closer to the front side than the protrusion and it is not necessary to form a groove on the outer circumferential surface of the part. Thus, a direction of pulling out a die for forming a groove on the outer circumferential surface of the frame does not cross a direction of pulling out a die for forming the protrusion, thereby facilitating pulling out the dies in molding. The frame can easily be molded by a simple die thereby reducing the cost.

The engagement member is engaged in the cut-away portion of the frame. The circumference of the upholstery material engages in grooves on the outer circumferential surfaces of the engagement member and the frame, so that the upholstery material can be stretched on the front side of the protrusion of the frame securely without loosening with good appearance.

Furthermore, it is not necessary to form a through hole in the protrusion of the frame thereby keeping strength of the upholstery material with good appearance.

(2) In the item (1), the longitudinal cut-away portion of the frame is longer than the protrusion on the frame, and the engagement portion is almost as long as the cut-away portion.

Thus, the upholstery material can be stretched easily. If the cut-away portion of the frame is shorter than the protrusion along the frame, a hand comes in contact with the protrusion to make its operation more difficult when the engagement member engages in the cut-away portion. However, if the cut-away portion and engagement member are longer than the protrusion, the hand is prevented from coming in contact with the protrusion thereby making it possible to stretch the upholstery material easily.

(3) In the item (1) or (2), the outer circumferential surface of the engagement member is continuous with the outer circumferential surface of the frame, and the groove of the frame is continuous with the groove of the engagement member, so that the edge of the upholstery material can be engaged in the two grooves easily.

(4) In any one of the items (1) to (3), the grooves are formed from the outer circumferential surfaces of the frame and the engagement member. The circumference of the upholstery material can be engaged in the grooves securely.

(5) In any one of the items (1) to (3), the protrusion directing longitudinally of the frame is provided on the outer circumferential; surfaces of the frame and the engagement member close to the front side of the frame. The groove is formed on the back side of the protrusion.

Thus, the edge of the frame can be mounted to the frame more easily.

Figure 6:
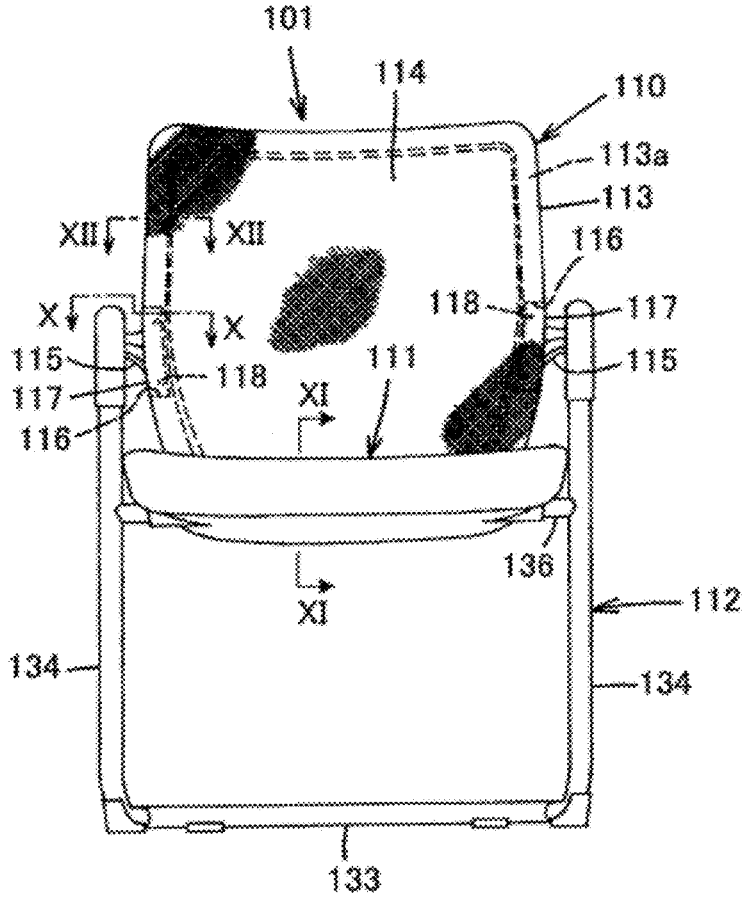
FIG. 6 is a front elevational view of a chair having Embodiment 2 of the present invention.
Figure 7:
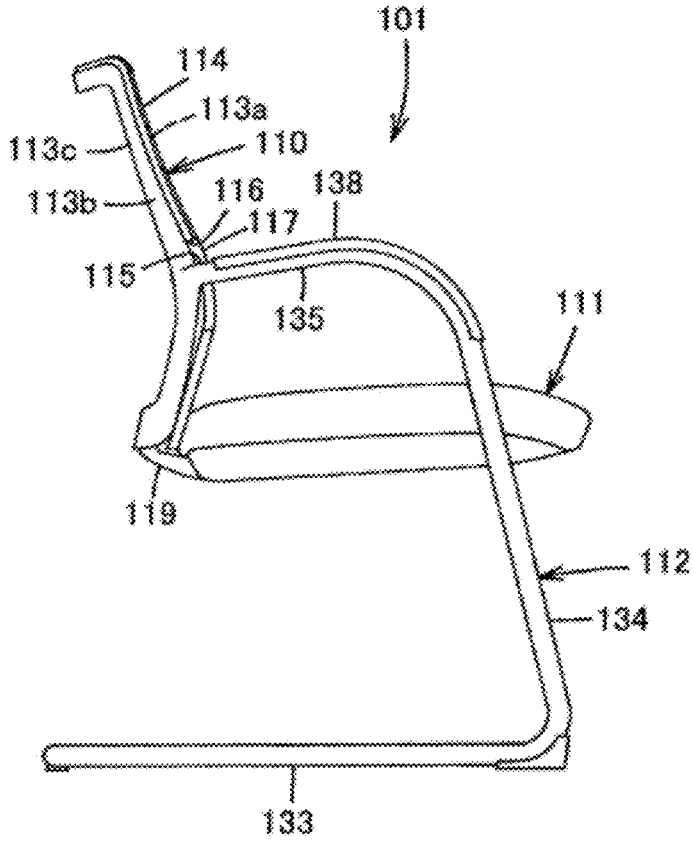
FIG. 7 is a side elevational view of the chair in FIG. 6.

Embodiment of the present invention will be described with respect to the appended drawings as below. FIG. 6 is a front elevational view of a chair in which Embodiment 2 of the present invention is applied, and FIG. 7 is a side elevational view thereof. In the embodiments, the present invention is applied to the structure for stretching upholstery material in the backrest of a chair.

Figure 8:
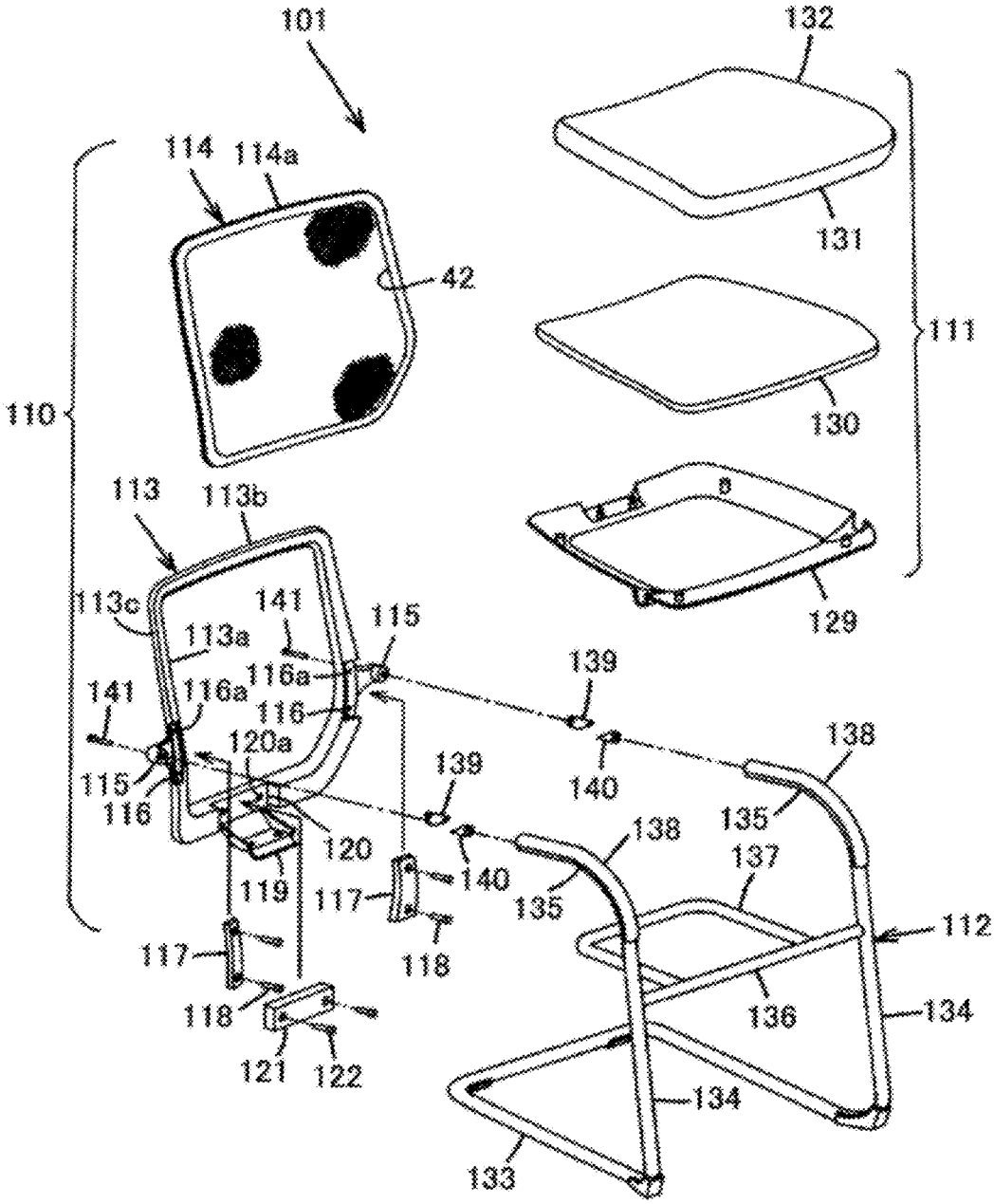
FIG. 8 is an exploded front perspective view of the chair in FIG. 6.
Figure 9:
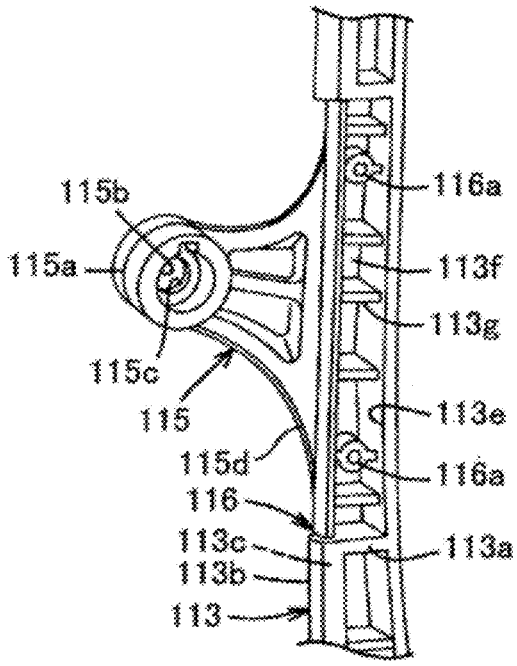
FIG. 9 is a front perspective view showing a cut-away portion of a frame in FIG. 6.

A chair 101 comprises a backrest 110, a seat 111 and a leg frame 112 for supporting the backrest 110 and the seat 111. In FIG. 8, the backrest 110 comprises a closed-loop frame 113 and upholstery material 114 stretched over a front side of the frame 113 in FIG. 7. There is provided a pair of ears 115,115 for connecting the frame 113 to the leg frame 112 at the sides of an outer circumferential surface 113*b* close to a back side 113*c*. In FIG. 9, a boss 115*a* is formed at the end of the ear 115. In the boss 115*a*, a blind hole 115*b* faces a front side 113*a* of the frame 113, and a through hole 115*c* is formed in the bottom of the blind hole 115*b*.

In FIGS. 8 and 9, in front of the ears 115 at the sides of the frame 113, there are cut-away portions 116,116 which are as high as a base 115*d* of the ear 115.

Figure 10:
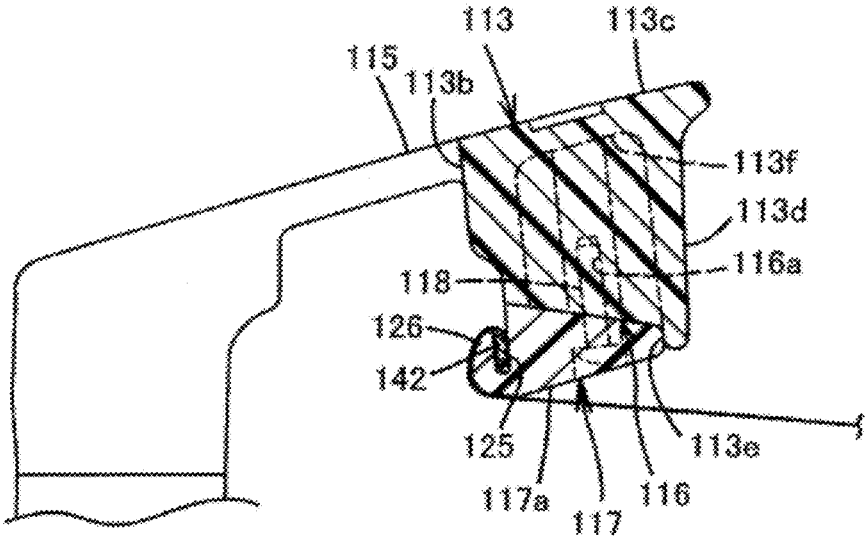
FIG. 10 is an enlarged horizontal sectional plan view taken along the line X-X in FIG. 6.

There are formed threaded holes 116*a*,116*a* at the upper and lower ends of each of the cut-away portions 116,116. In FIG. 10, on an inner surface 113*c* of the frame 113 in the cut-away portion 116, there is provided a projection 113*e* projecting toward the front side 113*a*. An outer surface 113*b* of the frame 113 in the cut-away portion 116 is open.

In FIGS. 8 and 10, an engagement member 117 engages in each of the cut-away portions 116, 116. Each of the engagement members 117 is mounted to the frame 113 with a screw 118 which engages the threaded hole 116*a*. The front side 117*a* and the outer surface 117*b* of the engagement member 113 are continuous with the front side 113*a* and the outer surface 113*b* of the frame 113.

In FIG. 8, a lower connecting part 110 for coupling to the seat 111 is provided at the lower end of the frame 113. On the lower surface of the frame 113, there is formed a cut-away portion 120 which is wider than the lower connecting part 110.

Figure 11:
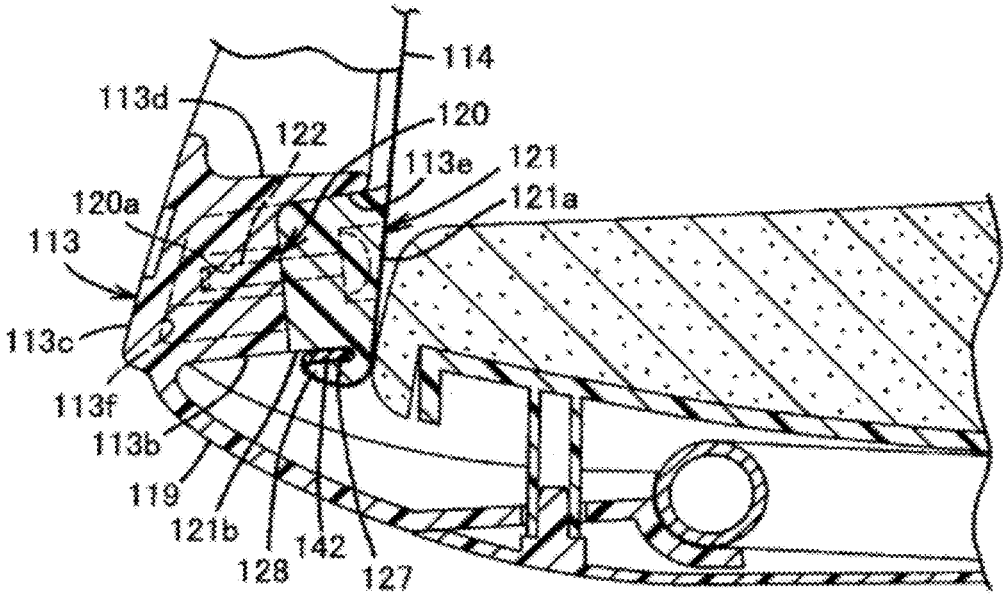
FIG. 11 is an enlarged vertical sectional side view taken along the line XI-XI in FIG. 6.

The cut-away portion 120 is almost the same as the cut-away portion 116. At each side of the cut-away portion 120, a threaded hole (not shown) is formed. In FIG. 11, on an inner circumferential surface 113*d* of the frame 113 in the cut-away portion 120, there is provided a projection 113*e* which projects toward the front side 113*a* and the frame 113 is open at an outer circumferential surface 113*b*.

In FIGS. 8 and 11, an engagement member 121 engages in the cut-away portion 120. The engagement member 121 is mounted to the frame 113 with a screw 122. The front side 121*a* and the outer circumferential surface 121*b* are continuous with the front side 113*a* and the outer circumferential surface 113*b* of the frame 113.

Figure 13:
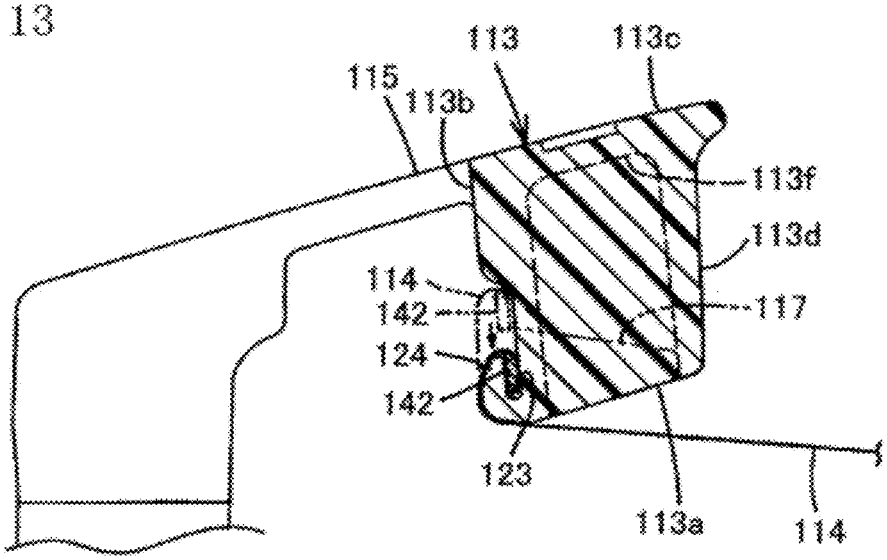
FIG. 13 is a view showing how to engage an edge sewn on the circumference of upholstery material in groove of the frame and an engagement member.

In FIG. 13, the frame has an almost rectangular cross-section which becomes gradually smaller upward. In FIG. 9, within the frame 113, there are formed a recess 113*f* and a rib 113*g*.

Figure 12:
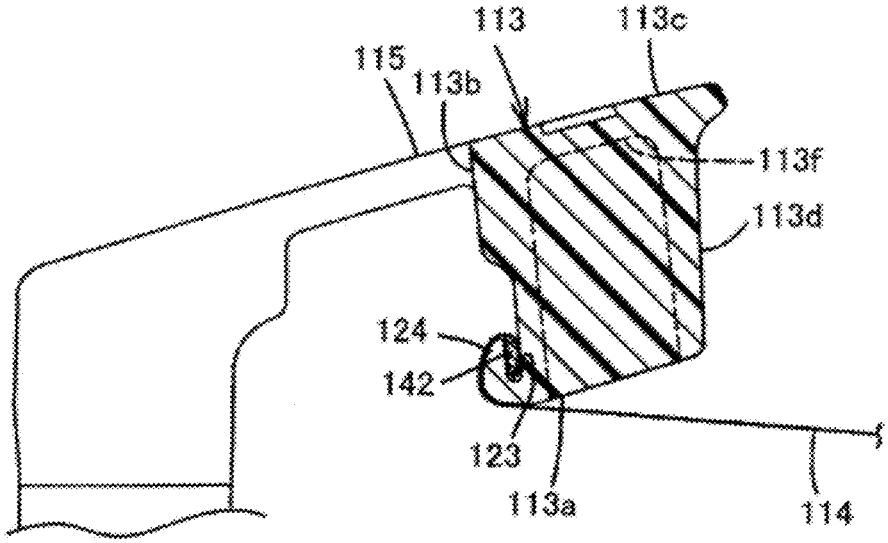
FIG. 12 is an enlarged horizontal sectional plan view taken along the line XII-XII in FIG. 6.

In this embodiment, in FIG. 12, on the outer circumferential surface of the frame 113, a projection 124 is formed longitudinally of the frame 113 closer to the front side 113*a* than the ears 115,115 and the lower connecting part 110. A longitudinal groove 123 is formed and is open rearward. The groove 123 is formed except the cut-away portions 116,116 of the frame 113 and the cut-away portion 120.

In FIG. 10, a longitudinal groove 125 is formed on the engagement member 117. Like the groove 123 of the frame 113, with the groove 125, a longitudinal projection 126 is provided on an outer circumferential surface 117*b* of the engagement member 117 closer to the front side 117*a*. The groove 125 is open rearward.

In FIG. 11, a groove 127 is formed on an engagement member 121. A projection 128 is formed longitudinally of the engagement member 121 on an outer circumferential surface 121*b* of the engagement member 121 close to a front side 121*a*.

In FIG. 8, the seat 111 comprises a closed loop frame 129, a seat shell 130 mounted to the frame 129, a seat cushion 131 mounted to the seat shell 130 and upholstery material 131 stretched over the front side of the seat cushion 131.

In FIGS. 7 and 8, a leg frame 112 comprises a U-shaped base leg 133 which is open forward; a pair of front legs 134,134 extending upward from the front end of the base leg 133; and armrests 135,135 extending rearward from the upper ends of the front legs 134,134 horizontally. The front legs 134,134 are coupled to each other with a lateral rod 136. A U-shaped support 137 is mounted to the lateral rod 136 to support the seat 111. Synthetic-resin arm pads 138,138 are provided on the armrests 135,135. The leg frame 112 may preferably comprise double pipes partially or entirely to improve strength.

In FIG. 8, the ears 115 of the frame 113 are connected to the armrests 135 of the leg frame 112 with screws 141 via through holes 115*c* in FIG. 9 of the ears 115 and threaded parts 139,140 disposed in the armrests 135 of the leg frame 112.

The upholstery material 114 of the backrest 110 is made of meshes elastically. A circumference 114*a* of the upholstery material 114 is formed like a bag, and an edge 142 is sewn therein. The edge 142 is made of elastic synthetic resin like an elongate plate.

Then, how to assemble the chair will be described. In FIG. 8, in order that the upholstery material 114 is stretched over the front side 113*a* of the frame 113 of the backrest 110, the engagement members 117,121 are engaged in the cut-away portions 116,120 of the frame and mounted with the screws 118,120.

Then, in FIG. 13, the upholstery material 114 in which the edge 142 is sewn on the circumference 114*a* is put on the front side 113*a* of the frame 113. Thereafter, the edge 142 of the upholstery material 114 is stretched by a suitable force as shown by a phantom line in FIG. 13 from the outer circumferential surface 113*b* toward the back side 113*c*. Then, as shown by a solid line in FIG. 13, the edge 142 is inserted in the grooves 123,125,127. Thus, the edge 141 is stretched toward the front side 113*a* of the frame 113 by a tension of the upholstery material 114. The edge 141 is engaged in the grooves 123,125,127. The upholstery material 114 is stretched over the front side 113*a* of the frame 113.

In order that the chair 101 is scrapped or in order that the upholstery material 114 is replaced, the upholstery material 114 is broken through by a tool (not shown) such as a screwdriver. The tool engages in the heads of the screws 118,122, which is removed, so that the engagement members 117,118, 121 can be taken off easily. The upholstery material 114 can be replaced easily thereby contributing separate collection of wastes.

According to Embodiment 2 of the present invention, the ears 115 and the lower connecting part 110 are provided on the outer circumferential surface 113*b* close to the back side 113*c* of the frame 113. The engagement members 117,121 are engaged in the cut-away portions 116,120 and mounted. The grooves 123,125,127 are formed on the outer circumferential surface 113*b* of the frame 113 closer to the front side 113*a* than the ears 115 and connecting part 110 and on the outer circumferential surface 117*b*,121*b* of the engagement member 117,121. In the grooves 123,125,127, the edge 142 which is sewn on the circumference 114*a* of the upholstery material 114 is engaged and mounted. Thus, the circumference 114*a* of the upholstery material 114 can be mounted to the ears 115 and the connecting part 110 of the frame 113 more securely. Even when the ears 115 and the lower connecting part 110 for mounting the leg frame 112 or the seat 111 to the frame 113 are provided, the circumference 114 of the upholstery material 114 can be engaged to the ears 115 and the lower connecting part 110 of the frame 113, so that the upholstery material 114 can be kept from loosening.

The cut-away portions 116,120 are longer than the ears 115 and the connecting part 110, so that the circumference 142 of the upholstery material 114 can be engaged with the ears 115 and the lower connecting part 110 more securely.

As described as below, the upholstery material 114 can be secured more easily. If the cut-away portions 116,120 of the frame 113 are shorter than the ears 115 and the lower connecting part 110, a hand hits the ears 115 and the connecting part 110 to make its operation more difficult when the engagement members 117,121 engage in the cut-away portions 116, 120. In contrast, in this embodiment, the cut-away portions 116,120 of the frame 113 and the engagement members 117, 120 are longer than the ears 115 and the lower connecting part 110. When the upholstery material 114 engages in the grooves 125,127 of the engagement members 117,121, a hand is kept from hitting the ears 115 and the lower connecting portions 119, so that the upholstery material 114 can be stretched more easily.

It is not necessary to form a hole through the ears 115 and the lower connecting part 110 of the frame 113, so that its appearance is kept good. The groove 123 of the frame 113 is not formed in the vicinity of the ears 115 and the lower connecting part 110 of the frame 113, so that a direction for pulling out a die for forming the groove 123 does not cross a direction for pulling out a die for forming the ears 115 and the connecting part 110 thereby enabling a single molding with the same die to reduce its cost.

The outer circumferential surfaces 117*b*, 121*b* of the engagement member 117,121 are continuous with the front side 113*a* and the outer circumferential surface 113*b* of the frame 113, so that the bases of the ears 115 and the connecting part 110 of the frame 113 can be hindered by the engagement members 117,121. Furthermore, although the engagement members 117,121 are separate from the frame 113, a boundary between the engagement members 117,121 and the frame 113 is not exposed, providing good appearance. The groove 123 of the frame 113 is continuous with the grooves 125,127 of the engagement members 117,121, thereby simplifying the shape of the edge 141 of the upholstery material 114 mounted in the grooves 123,125,127.

The grooves 123,125,127 of the frame 113 and the engagement members 117,131 are formed toward a center from the outer circumferential surfaces 113*b*,117*b*,121*b* of the frame 113 and the engagement members 117,121, so that the edge 137 of the upholstery material 114 can be mounted to the grooves 123,124,127 more securely.

The grooves 123,125,127 are formed on the outer circumferential surface 113*b*,117,121*b* of the frame 113 and the engagement members 117,121 at back side of the longitudinal projections 124,126,128 longitudinally of the frame 113 close to the front sides 113*a*,117*a*,121*a*, so that the edge 142 of the upholstery material 114 can be inserted into the grooves 123,125,127 more easily.

Different embodiments of the present invention can be made without departing from the scope of claims.

The present invention is applied to the backrest of a chair in the foregoing embodiments, but may be applied to the seat and headrest of the chair by modifying a direction and shape.

As described as above, according to the present invention, in the chair in which the frame over which the upholstery material is stretched is connected to another member of the chair, it is easy to pull out a die for molding the frame. The frame can be molded more easily and the upholstery material can be kept from loosening. And the present invention provides the stretching structure for upholstery material for a chair having good appearance and cost reduction.

Specifically, in the chair in which the frame over which the upholstery material is stretched is coupled to another member such as the leg frame, in order that the upholstery material can be stretched over the frame more securely with good appearance and cost reduction, the cut-away portion 116 is formed closer to the front side 113*a* than the ears 115 of the frame 113, the engagement member 117 is engaged in the cut-away portion 116 and mounted, and the grooves 123,125 in which the circumference 114*a* of the upholstery material 114 engages are formed on the outer circumferential surface 113*b* of the frame 113 closer to the front side 113*a* than the ears 115 and on the outer circumferential surface of the engagement member 117.

DESCRIPTION OF SYMBOLS

1 chair
2 leg frame
3 seat
4 backrest
5 base leg
6 front leg
7 armrest
8 lateral rod
9 seat-support rod
10 cushion material
11 seat plate
12 lower cover
13 frame
14 upholstery material
15 outward ear
16, 17 connecting portion
18 bolt
19 lower connecting part
20 engagement groove

21 upholstery-material-holding portion
22 recess
23 U-shaped portion
23*a* outer portion
23*b* inner portion
24 edge
25 rib
26, 27 cut-away portion
28, 29 engagement member
30 screw
101 chair
110 backrest
111 seat
112 leg frame
113 frame
113*a* front side
113*b* outer circumferential surface
113*c* back side
113*d* inner circumferential surface
113*e* projection
113*f* recess
113*g* rib
114 upholstery material
115 outward ear (projection)
115*a* boss
115*b* blind hole
115*c* through hole
115*d* base
116 cut-away portion
116*a* threaded hole
117 engagement member
117*a* front side
117*b* outer surface
118 screw
119 lower connecting portion (projection)
120 cut-away portion
121 engagement member
121*a* front side
121*b* outer circumferential surface
122 screw
123, 125, 127 groove
124, 126, 128 projection
129 frame
130 seat shell
131 seat cushion
132 upholstery material
133 base leg
134 front legs
135 armrest
136 lateral rod
137 support
138 arm pad
139, 140 threaded part
141 screw
142 edge

What is claimed is:

1. A stretching structure of upholstery material used for a seat or a backrest of a chair, in which the upholstery material is stretched over a closed-loop frame, the frame, in a cross section perpendicular to a longitudinal direction of the frame, comprising:

an upholstery-material-holding portion having an engagement groove which is open toward a back side of the frame and;

a U-shaped portion having a recess which is open toward a front side of the frame and medial to the engagement groove, wherein the upholstery material is wound from the front side toward the back side of the frame along an outer circumferential surface, and a circumference of the upholstery material is engaged in the engagement groove so that the upholstery material is stretched to cover the U-shaped portion.

2. The stretching structure of claim 1 wherein a free end of an inner portion of the U-shaped portion is spaced from a back side of the upholstery material when external force does not act.

3. The stretching structure of claim 2 wherein a free end of an outer portion of the U-shaped portion is spaced from an outer circumference of the upholstery-material-holding portion in a direction of separating from the back side of the upholstery material, and a free end of the inner portion of the U-shaped portion is more spaced from the back side of the upholstery material than from the free end of the outer portion of the U-shaped portion in the direction of separating from the back side of the upholstery material.

4. The stretching structure of claim 3 wherein a surface formed by connecting the outer circumference of the upholstery-material-holding portion, the free end of the outer portion and the free end of the inner portion is a gently curved or tilted surface concaved from the outer circumference of the upholstery-material-holding portion toward the back side of the upholstery material.

5. The stretching structure of claim 3 wherein a cross section perpendicular to a longitudinal direction of the frame is formed such that depth becomes larger gradually inward from the outer circumference of the upholstery-material-holding portion.

6. The stretching structure of claim 1 wherein in the recess of the U-shaped portion, a rib perpendicular to a longitudinal direction of the recess is formed.

* * * * *